United States Patent [19]

Lap

[11] Patent Number: 4,473,223

[45] Date of Patent: Sep. 25, 1984

[54] SORTER FOR COLLATING SHEETS INTO SETS

[75] Inventor: Johannes Lap, Venlo, Netherlands

[73] Assignee: Xerox Corporation, Stamford, Conn.

[21] Appl. No.: 363,732

[22] Filed: Mar. 30, 1982

[30] Foreign Application Priority Data

Mar. 31, 1981 [GB] United Kingdom ..... 8110038

[51] Int. Cl.[3] ..... B65H 39/105

[52] U.S. Cl. ..... 271/294; 271/295

[58] Field of Search ..... 271/293, 294, 295, 292, 271/287

[56] References Cited

U.S. PATENT DOCUMENTS

| | | | |
|---|---|---|---|
| 3,721,435 | 3/1973 | Zanders | 271/293 |
| 4,203,587 | 5/1980 | Kishi | 271/293 |
| 4,332,377 | 6/1982 | Du Bois | 271/293 |
| 4,398,712 | 8/1983 | George | 271/293 |

FOREIGN PATENT DOCUMENTS

| | | | |
|---|---|---|---|
| 0061925 | 10/1982 | European Pat. Off. | 271/295 |
| 54-12921 | 1/1979 | Japan | 271/294 |

OTHER PUBLICATIONS

Xerox Disclosure Journal, vol. 1, No. 4, Apr. 1976, p. 59.

*Primary Examiner*—Duane A. Reger
*Assistant Examiner*—John A. Carroll

[57] ABSTRACT

A sorter for collating sheets into sets comprises a plurality of sheet-receiving bins B defined by an array of movable plates 1–5, 5a and an indexing wheel 23 for indexing the input ends of the bin plates sequentially past a fixed feed throat 22 to align the bin openings in turn with the feed throat 22. Adjacent bin plates 1–5, 5*a* are relatively movable apart and together for varying the sizes of the bin openings and are interconnected to limit their maximum spacing. The bin plates are arranged in a fan-like array and are so mounted that their inner ends abut to define the maximum bin spacing.

14 Claims, 6 Drawing Figures

5a
48
5
4
3
2
1
47
49
48

SORTER FOR COLLATING SHEETS INTO SETS

BACKGROUND OF THE INVENTION

This invention relates to sorters for collating sheets into sets and is particularly but not exclusively concerned with sorters suitable for use with or as part of an office reproduction machine.

Frequently, it is highly desirable to reproduce a plurality of copies of the same original document or information. Moreover, if several original documents are reproduced, it is desirable to produce a plurality of collated sets of copies. This may be achieved by the utilisation of a sorter. Generally the sorter comprises a plurality of bins wherein each bin is designed to collect one set of copies of the original document. A variety of sorters are known in the art. Most sorters used commercially with photocopiers comprise a plurality of tray members which are spaced apart and extend in an array, which may be horizontal as for example in U.S. Pat. Nos. 3,944,207 and 4,015,841, or vertical as in U.S. Pat. No. 3,977,667. Such sorters take various well known forms. There are travelling gate sorters as described for example in U.S. Pat. No. 3,414,254 in which sheets are conveyed by a sheet transport past the openings of a vertical array of bins and a movable gate or feed throat traverses across the bin openings for deflecting the sheets into the respective bins in turn. Another type has fixed bins and a deflector or gate associated with each bin; a sheet transport advances the copy sheets past the bin openings and the deflectors are actuated in turn to guide the sheets from the transport into the respective bins. Finally, in moving bin sorters such as described in U.S. Pat. Nos. 3,788,640 and 4,055,339, the bins themselves are indexed past a fixed feed throat. Within such class of sorters may be included rotary sorters having bins extending radially outwardly from an axis of rotation, as shown for example in U.S. Pat. No. 3,851,872. It is also known from U.S. Pat. No. 4,073,118 to have a fan-like array of bins indexed past a fixed feed throat.

For maximum compactness for a given capacity, the bins should preferably be completely filled. However, the capacity of the bins is limited by the space required over the stack for insertion of the final sheet. To alleviate this difficulty it is known from various of the above mentioned patents that the bin entrance openings of the respective bins may be selectively increased in size by relatively moving the bin plates defining the opening as a sheet is fed into it.

This invention is concerned with sorters of the moving bin type and in particular with a sorter such as shown in Xerox Disclosure Journal Vol. 1 No. 4 April 1976 Page 59 which comprises a plurality of sheet-receiving bins defined by an array of movable plates and means for indexing the input ends of the bin plates sequentially past a fixed feed throat to align the bin openings in turn with the feed throat, adjacent said bin plates being relatively movable apart and together for varying the sizes of the bin openings. No indexing means is described in that disclosure. Such a sorter is also disclosed in Japanese Published Application No. 53-79545 where a unidirectional indexing system includes a Geneva wheel which allows the bins to fall past the feed throat one at a time.

SUMMARY OF THE INVENTION

The present invention is characterised in that the bin plates are arranged in a fan-like array and are so mounted that their inner ends abut to define a maximum spacing between adjacent plates.

Such an arrangement provides particularly accurate positioning of the bin plates so ensuring alignment of the bin openings with the feed throat.

In a preferred form the bin plates are pivotally mounted by projecting through an arcuate mounting plate and the mounting plate itself is suitably pivotally mounted, one outer bin plate being rigid therewith.

In preferred embodiments the sorter embodies one or more features of the invention disclosed in our copending application Ser. No. 363,731 filed concurrently herewith (our case No. R 79004), which features are also described hereinbelow.

BRIEF DESCRIPTION OF THE DRAWINGS

In order that the invention may be more readily understood, reference will be made to the accompanying drawings in which.

DESCRIPTION OF THE PREFERRED EMBODIMENTS

Figure 1:
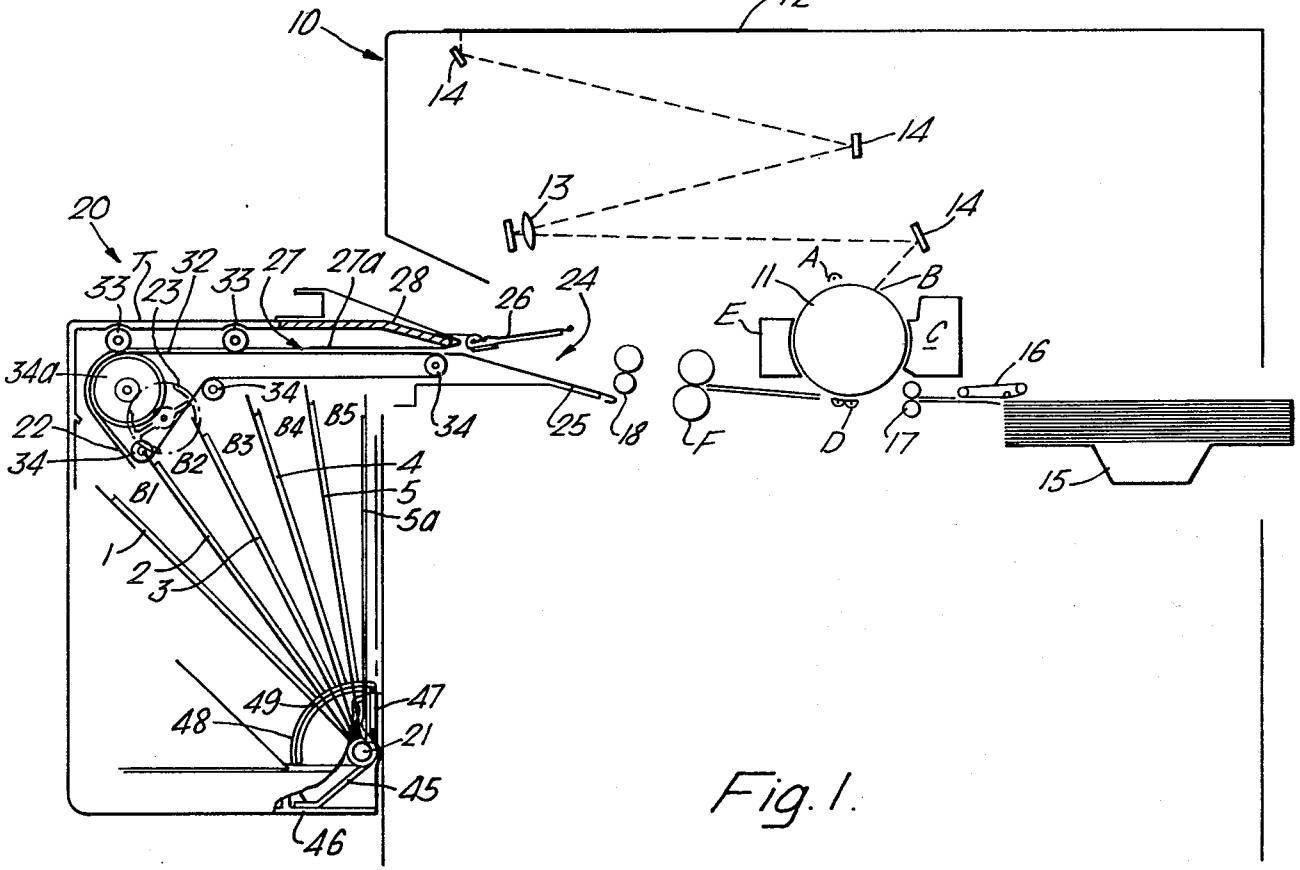
FIG. 1 shows schematically a side elevation of a xerographic copier having one embodiment of sheet sorter according to the invention.

Referring to FIG. 1, there is shown an automatic xerographic reproducing machine 10 having attached thereto a sheet sorter 20 according to this invention for collecting copy sheets produced in machine 10. Although the present invention is particularly well suited for use in automatic xerography, the apparatus 20 is equally well adapted for use with any number of devices in which cut sheets of material are delivered serially for collating into sets.

The processor 10 includes a photosensitive drum 11 which is rotated in the direction indicated by the arrow so as to pass sequentially through a series of xerographic processing stations; a charging station A, an imaging station B, a developer station C, a transfer station D, and a cleaning station E.

A document to be reproduced is placed on a platen 12 and scanned by means of a moving optical system including a lens 13 and mirrors 14 to produce a flowing light image on the drum surface at B, the drum surface having been charged at A. Then the image is developed at C to form a visible toner image. Cut sheets of paper are moved into transfer station D from an elevating delivery tray 15 by means of a sheet feeder 16 via sheet registering apparatus 17 in synchronous relation with the image on the drum surface. Following transfer, the copy sheet is stripped from the drum surface and directed to a fusing station F. The drum surface itself continues past the cleaning station E at which residual toner remaining on the drum surface is removed prior to the drum surface again being charged at A. Upon leaving the fuser, the fixed copy sheet is passed to the processor output rolls 18 which are immediately next to or may form the input to the sorter 20. As will be apparent from a study of FIG. 1, the copy sheets are conveyed to the sorter 20 face-up.

Referring to FIGS. 1 to 6, the sorter 20 comprises five sheet-receiving bins B1–B5. The bins are defined by an array of movable plates 1–5 which respectively support sheets delivered to the bins and a cover plate 5*a* next to the bin 5. The array of bin plates is pivotally mounted for rotation about a fixed axis 21 for indexing the input ends of the bin plates 1–5 sequentially past a fixed or stationary feed throat 22 through which sheets are serially delivered from the processor 10 to align the bin openings in turn with the feed throat. Indexing of the bin plates is achieved in this embodiment by a bi-directional indexing wheel 23 as described in detail below. The bin plates themselves are relatively movable apart and together for varying the sizes of the bin openings.

Figure 2:
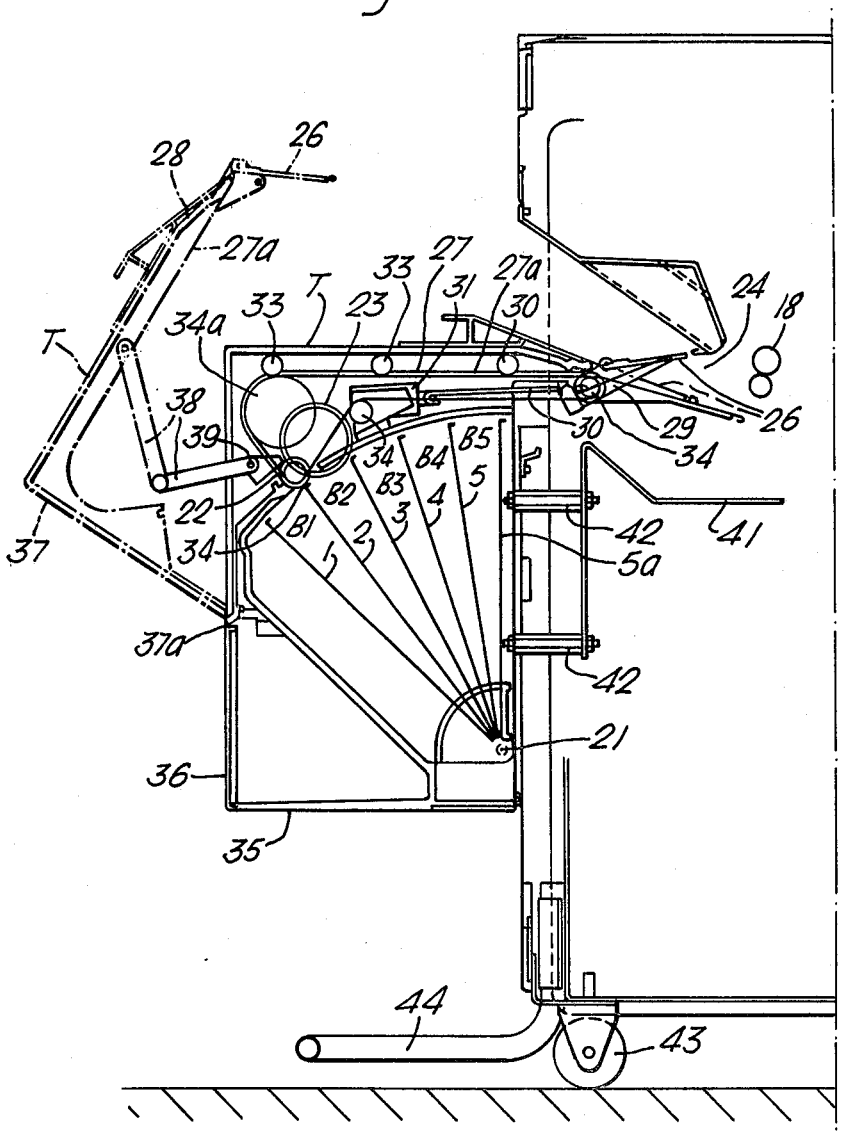
FIG. 2 is an enlarged view like that of FIG. 1 showing the sorter and its manner of attachment to the copier in greater detail.

As shown in FIGS. 1 and 2, the sorter 20 is mounted on the output side of the processor 10 with its input 24 opposite the processor rolls 18. The input 24 of the sorter comprises a fixed lower guide plate 25 and a pivotally mounted upper diverter baffle 26 which may be moved between a raised position as shown in full lines in FIGS. 1 and 2 in which sheets are directed along path 27 to fixed feed throat 22 and a lowered position as shown in dotted lines in FIG. 2 in which sheets are directed across surface 28 to a casual tray T formed by the top of the sorter. The casual output or non-sort tray T collects copies when they do not need to be sorted or the sorter is inoperative, or can be used as an overflow when the sorter is full.

As shown in FIG. 2, the movable diverter baffle 26 is shifted between its raised and lowered limit positions by a pivotally mounted lever 29 which is actuated through a rod 30 by a solenoid 31. The lever is biassed by a spring 29*a* to its raised position and activation of the solenoid 31 lowers the lever. This arrangement enables the diverter plate 26 to be separated from its drive for jam access as explained below.

The bin array is arranged generally vertically and the path 27 includes a generally horizontal portion extending from input 24 across the top of the sorter and a downwardly inclined portion for directing sheets downwardly into the bins. Path 27 is defined by upper and lower baffle plates of which only the upper plate 27*a* is visible in the drawings. Sheets are conveyed along the path 27 by a central, narrow drive belt 32 e.g. 3.5 cm wide, set into the lower guide baffle and having co-operating reaction rolls 33 along the horizontal portion of the guide path. The belt is entrained over guide rollers 34 arranged to conform the belt to the path 27, including a large roller 34*a* which provides a smooth transition between the horizontal and inclined portions of the path.

By arranging the bins B in a generally vertical or upright array and collecting the sheets on the faces of the bin plates facing the processor, it will be seen that the sheets are supported in the bins face down so that sheets fed to the individual bins in the order 1—N are arranged in that sequence in the bins.

As shown in FIG. 2 the paper path 27 may be divided to provide access thereto particularly for clearing jammed sheets. To this end a portion of the cover 35 including the top and a section of the end wall 36 form an L-shaped door 37 carrying the upper baffle 27*a* and diverter baffle 26, which can be hinged to an open position as shown in FIG. 2 about pivot 37*a*. Folding links 38 are pivotally supported between the door 37 and a fixed mounting 39 on the sorter frame to limit the degree to which the door opens and prevent it from falling completely open. An interlock switch 40 (FIG. 3) switches off the sorter when the door 37 is opened.

The sorter is mounted on the processor 10 with its input 24 extending into an opening in the processor side wall opposite the output rolls 18. With this arrangement and by providing the diverter baffle 26 on the door 37, access to the paper path may be obtained right back to the processor output rolls 18.

As shown in FIG. 2, the sorter 20 hangs on the end of the processor, being connected to the frame 41 of the processor by spacer bolts 42. The processor itself is mounted on four castors 43 one of which is visible in FIG. 2 and in order to prevent the assembly from tipping over during transport or in the event of an excessive downward force being applied to the sorter, a foot 44 projects from the processor beneath the sorter.

Figure 3:
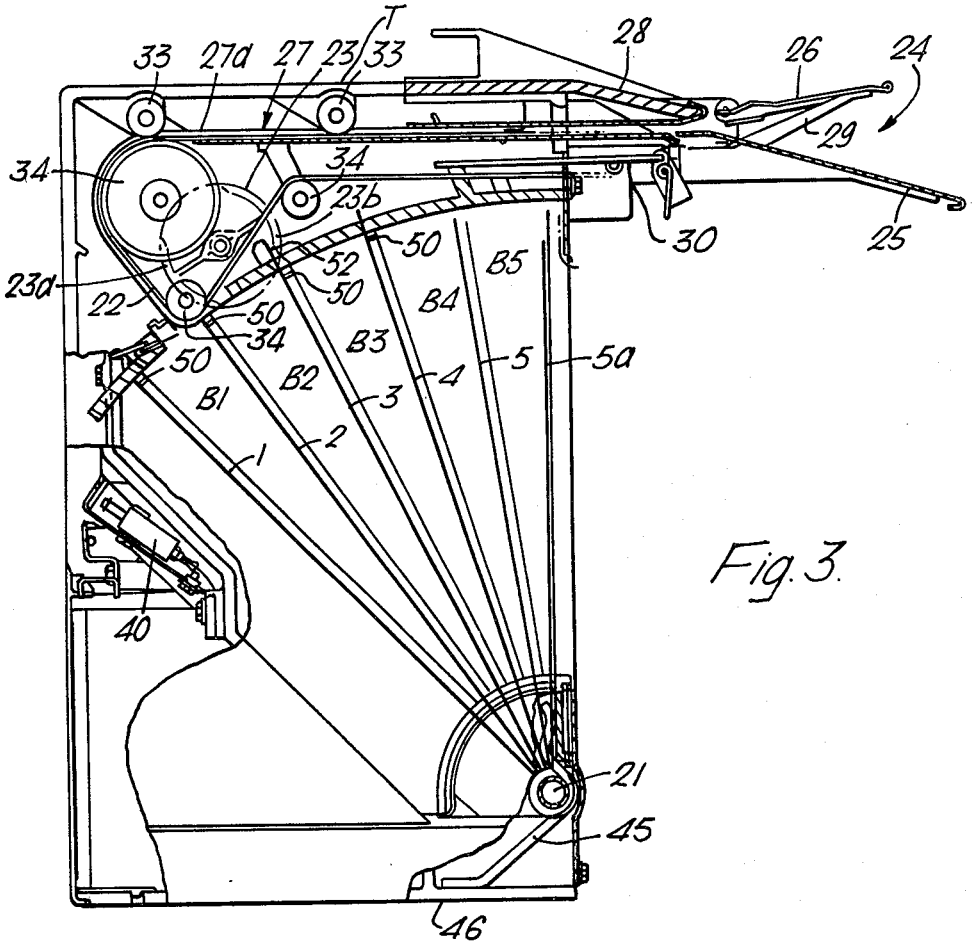
FIG. 3 is a further enlarged view like that of FIG. 1 of the sorter showing more detail.
Figure 4:
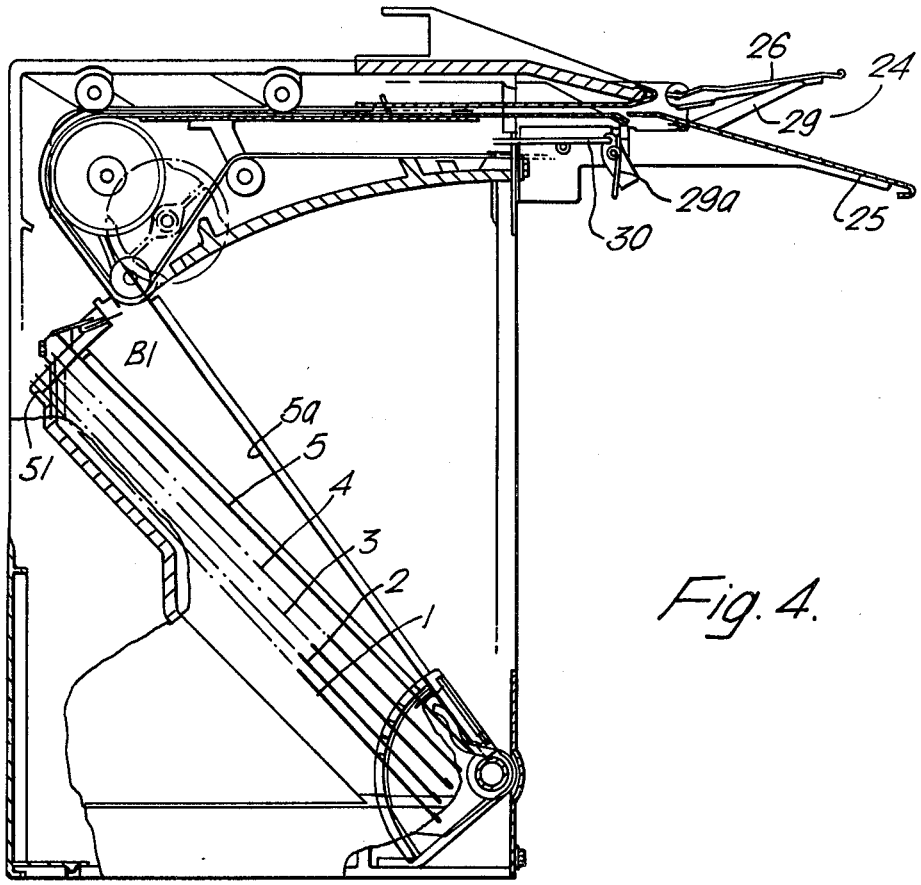
FIG. 4 is a view like that of FIG. 3 showing a different operative condition of the sorter.
Figure 5:
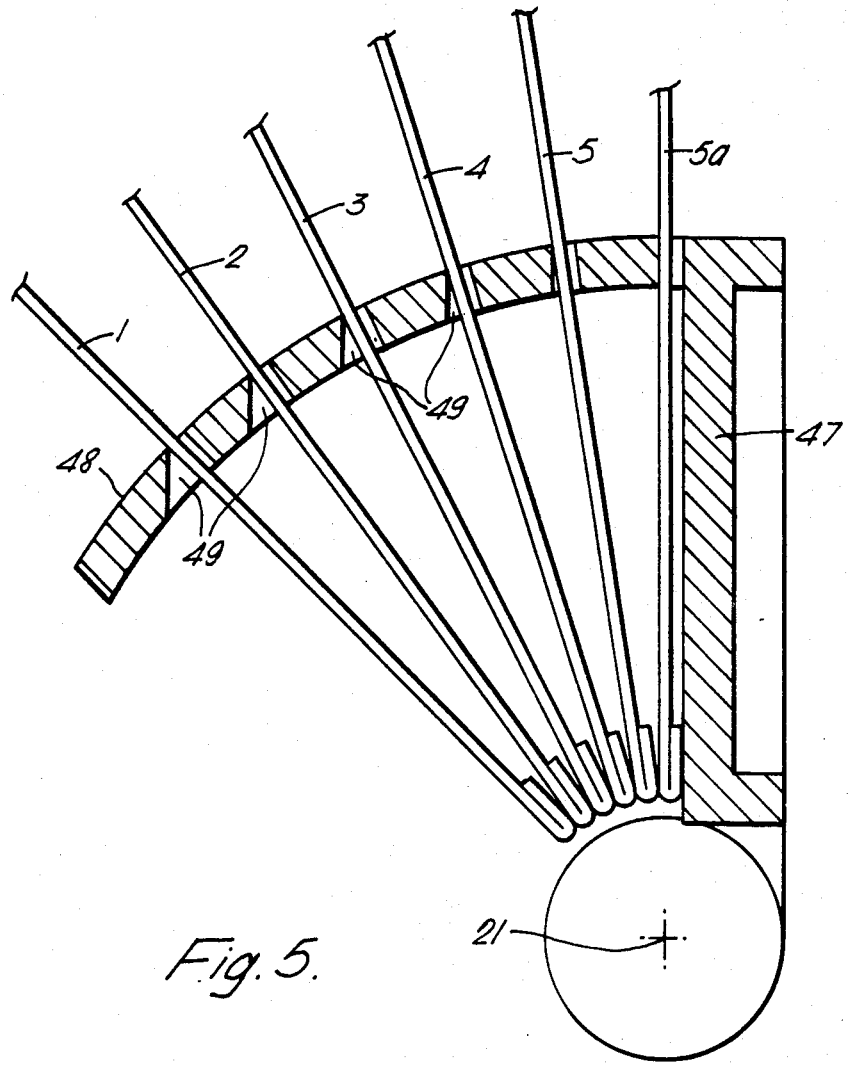
FIG. 5 is a scrap view still further enlarged of part of the sorter bin array in the condition shown in FIG. 3.
Figure 6:
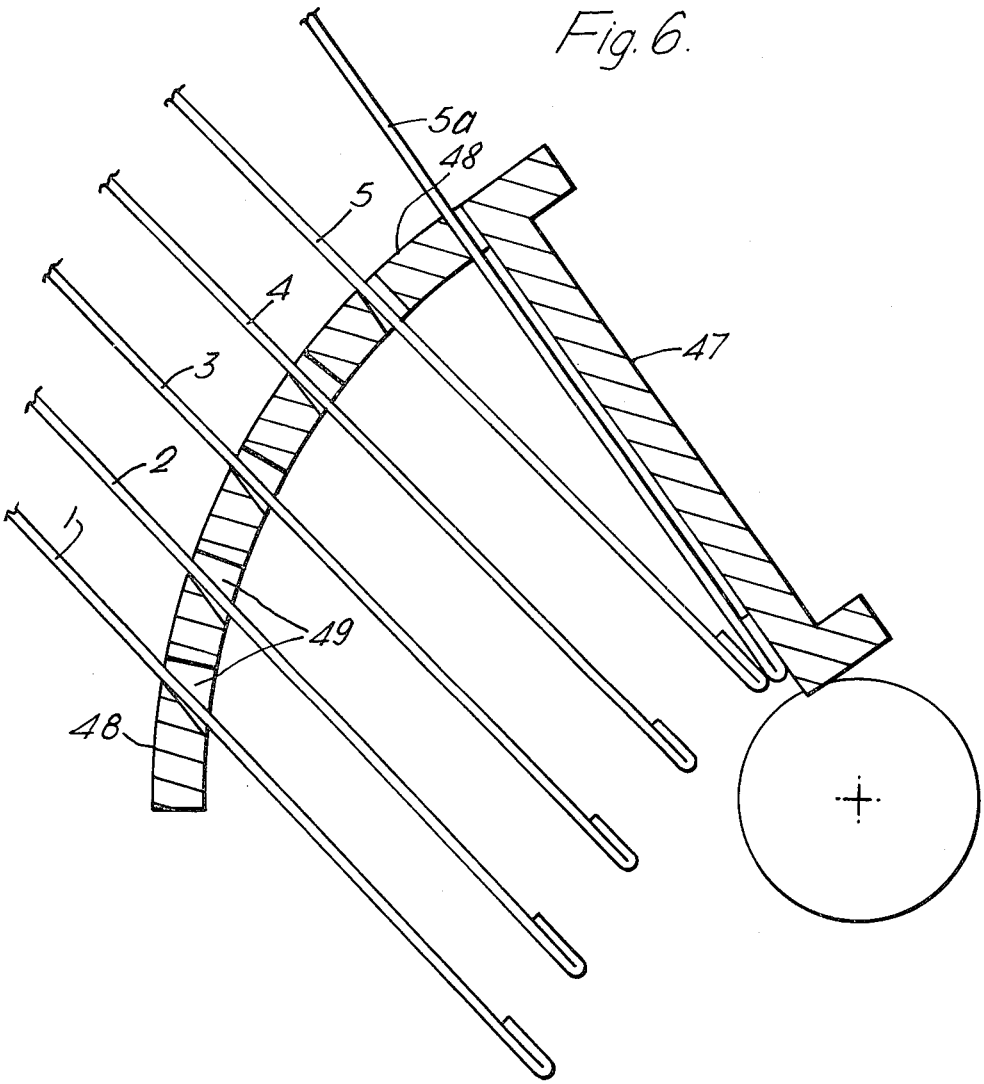
FIG. 6 is a view like that of FIG. 5 showing the bin array in the condition shown in FIG. 4.

The bins B are indexable by the wheel 23 between the position shown in FIG. 3 in which bin B1 is opposite the feed throat 22 and all the bins are enlarged to a maximum spacing and a position as shown in FIG. 4 in which the bin B5 is enlarged and opposite the feed throat and the bins B1–B4 are collapsed. With this arrangement the bins may all be enlarged as shown in FIG. 3 to facilitate removal of sheet sets from the bins without destroying their integrity while a space-saving producing a compact sorter arrangement is achieved by collapsing the bins at the outer side of the feed throat as shown in FIG. 4. In accordance with a preferred feature of the invention the spacing apart of the bin plates opposite the feed throat and at one side thereof is achieved by biassing the bin plates away from the indexing means towards that side thereof and interconnecting the bins so as to limit their maximum spacing and to permit engagement of the bin plates by the indexing means in opposition to the bias. Thus, it will be seen in FIG. 3 that the bin array is biassed in the clockwise direction or to the right by a torsion spring 45 which is fulcrumed about pivot axis 21 and has one end engaging a bin holder 47 on which the bin plates are carried while the other end engages a fixed part of the sorter frame or cover at 46.

In order to limit the maximum spacing of the bin plates, the bin plates are connected in the following manner. The bin plates 1–5 and 5*a* are carried by the bin holder 47 which is mounted for rotation about the axis 21 and includes an arcuate support plate 48. The bin plates 1–5 and 5*a* are themselves pivotally mounted relative to the holder 47 by fitting through slots 49 in the support plate 48 with their inner ends projecting behind the support plate. Movement of the plate 5*a* is limited by the side of holder 47 against which it lies, or it may be rigidly connected to the bin holder. The amount of projection of the plates is chosen so that the correct bin opening is obtained when their inner ends abut. Thus, with this arrangement, when the outer or sheet input ends of the bin plates are spread apart as shown in FIG. 3, the inner ends of the bin plates abut, the plate 5*a* being pressed against the bin holder 47, so limiting the maximum spacing of the bin plates. Thus in the condition of the sorter shown in FIG. 3, the bin plate 2 is held against the bias of spring 45 by the indexing wheel 23 as explained in detail below and the inner ends of bin plates 2 to 5 and 5*a* interact to equally space their outer ends. The bin plate 1 although not influenced by the spring 45 is, by reason of its attitude, biassed anticlockwise by gravity and its spacing from the plate 2 is likewise limited by the interaction of their inner ends. As shown in FIG. 4 the mounting arrangement of the bin plates allows them to collaspe into a generally parallel arrangement defined by stops 50 which limit the minimum spacing of the bin plates. The plates are caused to assume this arrangement by the plate 5 engaging and resting against a fixed stop 51.

The indexing wheel 23 is arranged to act on the output ends of the bin plates (except the plate 1 which by virtue of the relative disposition of the wheel 23 and feed throat 22 does not have to be engaged by the wheel) and successively engages outwardly projecting flanges 52. The indexing wheel 23 comprises a disc having a discontinuous annular flange defining two circumferentially spaced cams 23*a*, 23*b*. The bins are indexed anticlockwise past the feed throat 22 by clockwise rotation of the indexing wheel 23, and are indexed clockwise by anticlockwise rotation of the wheel, each indexing movement corresponding to a 180° rotation of the wheel. The maximum spacing of adjacent bin plates is slightly less than the diameter of the indexing wheel 23 so as to ensure that the bins are successively engaged by the wheel. At the same time, during each indexing movement, the wheel 23 engages the next bin plate before it disengages from the previous bin plate.

The indexing wheel 23 and drive belt 32 are driven by separate motors. Both motors are actuated by the machine logic when sort-mode is selected. The belt 32 is driven continuously upon selection of sort-mode while the indexing wheel is driven through a half-revolution clutch which is actuated once for each sheet conveyed to the sorter by a sensor (not shown) arranged in the feed throat 22 which detects when the sheet trail edge has cleared the feed throat. Alternatively the degree of rotation of the indexing wheel may be controlled by a cam surface on the indexing wheel on which a sensor rides, the latter switching off the motor at the completion of 180° rotation of the wheel. The same sensor in the feed throat 22 switches on the motor to initiate the indexing movement. The machine logic also controls the number of sets collated in accordance with the number of copies of each original produced by the processor by controlling the number of bins indexed past the feed throat during each sort cycle. The machine logic also controls the position of the baffle 26 depending whether sort or non-sort mode is selected.

The operation of the sorter will now be described. Firstly, in non-sort mode, the baffle 26 is arranged in its lowered position and sheets are delivered face-up to the tray T forming an uncollated stack. In sort mode, the solenoid 31 is actuated to raise the baffle 26 to guide sheets from the processor 10 into the path 27 where they are engaged by the feed belt 32 and carried out of the feed throat 22 into the bin opposite it. The belt 32 speed is greater than that of processor output rolls 18 to avoid the sheets buckling as they enter the sorter and, to provide a smooth change in speed as the sheet enters path 27, foam rollers (not shown) are provided on the shaft carrying the input roller 34. At the start of sorting (stand-by condition), the bins B are all open and arranged as shown in FIG. 3 and the first sheet is fed into the bin B1 which is opposite the feed throat 22. The bin plate 2 is resting against the exterior face of cam 23*a*, the leading edge of cam 23*b* is just ahead of the bin plate 3 and the bin plates 3 to 5 and 5*a* are spaced apart from each other and plate 4 by the spring 45 with the plate 5*a* in its limit position next to the end wall 53 of the sorter. The plate 1 is biassed by gravity away from the plate 4. Before delivery of the next sheet at the feed throat, the indexing wheel 23 is rotated clockwise through 180° in response to the sensing of the making of the next copy. As the wheel 23 rotates the leading edge of cam 23*b* engages the plate 3 and drives the plate 3 from right to left during which movement the plate transfers to the outside of cam 23*b* until it assumes the position occupied by the plate 2 in FIG. 3. During this movement the whole bin array rotates about axis 21, the plates 5*a* (together with bin holder), 5 and 4 by virtue of the interconnection of the plates and the plates 1 and 2 by gravity. At the end of this movement the bin B2 is opposite the feed throat 22 and the plate 1 has engaged stop 51 so that the bin B1 becomes partially closed. During the next indexing step the leading edge of cam 23*a* engages and transfers the plate 4. Indexing continues, assuming that five sets of the original document are being copied, to align bins B3, B4 and finally B5 in turn with feed throat. In its end position, the bin array is as shown in FIG. 4 with the plate 5*a* held against spring 45 by the wheel 23 so that bin B5 is opposite the feed throat. In this position the machine logic inhibits the indexing wheel for one cycle so that the last sheet of page 1 of the document being copied and the first sheet of page 2 of the document are fed into bin B5. The indexing wheel is now rotated anti-clockwise through 180° so that the bin the cam 23*b*. The indexing wheel continues to rotate releasing the bin plate 5*a* until it reaches its rest position shown in FIGS. 3 and 4. The bin B4 is now opposite the feed throat 22 and receives the next copy sheet. Further indexing movements of the wheel 23 bring plates 4, 3 and 2 in turn into engagement therewith thus successively aligning bins B3, B2 and B1 with the feed throat 22. With bin B1 opposite the feed throat the array has returned to its condition shown in FIG. 3. If there are only two pages in each set, the sorter now closes down but if there are three or more pages in each set, the wheel 23 is inhibited for feeding the first copy of page 3 into the bin B1 and then the bin array is indexed sheet-by-sheet back to its other end condition. Bidirectional indexing of the bin array continues untill all pages of the document being copied have been collated. If there are an even number of pages sorting terminates with the sorter in the condition shown in FIG. 3. In this case the sorter immediately shuts down and the sets can be readily removed as separate stacks due to the spaced arrangement of the bin plates. Where, however, an odd number of pages is sorted, sorting terminates with the sorter in the condition shown in FIG. 4. In order to facilitate removal of the sets with their integrity preserved, in this event, the machine logic instructs the indexing wheel to rotate continuously to return the bin array to the condition shown in FIG. 3. Or return to this condition may be operator controlled by a button on the sorter.

Such bidirectional indexing as described above is a great advantage when the copier includes an automatic or semi-automatic document handler where there is little delay between the feeding of the last copy of one document page and the first copy of the next. With manual document handling the delay is significantly greater and this permits a simplified control arrangement in which the sorter returns directly to its home or stand-by position of FIG. 3 between each document page and sorts undirectionally. With this arrangement the sorter will always finish in its standby condition whether there is an odd or even number of document pages sorted.

It will be realised that in another emdodiment, the feed throat 22 may be in line with the indexing wheel so that in the left-hand end position of the bin array the plate 5*a* is at the right of the wheel 23 and in the right-hand limit condition, the plate 1 is at the left of and engaged by the wheel.

Although in the embodiments described above the bin plates are biassed away from the indexing wheel at both sides thereof, by virtue of the generally vertical attitude of the bin array, it will be realised that the array need only be biassed in one direction. Thus, in the embodiments described above, a compression spring could press against the plate 5 so urging the plates to the left of the wheel 23 into contact with it. Or the array could be disposed in an attitude displaced 90° clockwise about axis 21 from that shown. In both cases the collapsed bin spacing and the circumferential spacing between the cams 23*a*, 23*b* must be coordianted to ensure that only one bin is collected by the wheel 23 during anticlockwise rotation.

Although specific embodiments have been described above, it will be understood that various modifications may be made to the specific details referred to herein without departing from the scope of the invention as defined in the appended claims. For example, particularly where the bins are collasped at both sides of the indexing wheel, the sets in adjacent bins may be relatively offset for example by having offset inner end stops in every other bin.

Although bin arrays composed of five bins have been described, a lesser or greater number of bins may be provided.

What is claimed is:

1. A sorter for collating sheets into sets comprising a plurality of sheet-receiving bins defined by an array of movable plates, means for indexing the input ends of the bin plates sequentially past a fixed feed throat to align the bin openings in turn with the feed throat; adjacent said bin plates being relatively movable apart and together for varying the sizes of the bin openings, and the bin plates being pivotally mounted in a fan-like array, and means for mounting the bin plates such that their inner ends abut to define a maximum spacing between adjacent plates at their outer ends, comprising an arcuate mounting plate positioned near the inner ends of the bin plates having openings therein through which the pivotally mounted bin plates project.

2. A sorter according to claim 1 including means for pivotally mounting the mounting plate, one outer bin plate being rigid with the mounting plate or restrained against rotation relative to the mounting plate.

3. A sorter according to claim 1, in which the bin plates are spaced apart opposite and at one side of the feed throat, being arranged together on the other side of the feed throat.

4. A sorter according to claim 3 including means for biassing apart the bin plates opposite the feed throat and at said one side of the feed throat.

5. A sorter according to claim 3 including means for biassing apart the bin plates at said one side of the feed throat, the indexing means serving to space apart the bin plates opposite the feed throat.

6. A sorter according to claim 3, in which the indexing means engages the bin plates sequentially and is operable to index the bin plates past the feed throat in both directions.

7. A sorter according to claim 1, in which said indexing means is adapted to engage the bin plates sequentially to transfer them in turn from each side to the other of the feed throat, the bin plates being biassed away from the indexing means in one direction and interconnected to limit their maximum spacing to permit engagement of the bin plates by the indexing means in opposition to said bias.

8. A sorter according to claim 7 including means for supporting the bin plates on the side opposite that at which they are biassed away from the indexing means so as to be spaced together.

9. A sorter according to claim 8 including means to limit the minimum spacing of the bin plates.

10. A sorter according to claim 7 in which the indexing means comprises a wheel which during each indexing movement engages the next bin plate before it disengages from the previous bin plate in both directions.

11. A sorter according to claim 10 in which the indexing wheel includes a discontinuous annular flange which engages the bin plates.

12. A sheet sorter according to claim 11 in which said annular flange includes two circumferentially spaced annular segments.

13. A sorter according to claim 1, in which said indexing means comprises a wheel having a discontinuous annular flange arranged to engage the bin plates sequentially to transfer them in turn from each side to the other of the feed throat.

14. A sheet sorter according to claim 13 in which said annular flange includes two circumferentially spaced annular segments.

* * * * *